US006375105B1

(12) United States Patent
Haven et al.

(10) Patent No.: US 6,375,105 B1
(45) Date of Patent: Apr. 23, 2002

(54) JAW CRUSHER TOGGLE BEAM HYDRAULIC RELIEF AND CLEARING

(75) Inventors: Matthew B. Haven, Cedarburg; Patrick Quella, Germantown; Brian P. Jaworski, Waukesha, all of WI (US)

(73) Assignee: Astec Industries, Inc., Mequon, WI (US)

( * ) Notice: Subject to any disclaimer, the term of this patent is extended or adjusted under 35 U.S.C. 154(b) by 0 days.

(21) Appl. No.: 09/531,627

(22) Filed: Mar. 21, 2000

(51) Int. Cl.[7] ..... B02C 17/14
(52) U.S. Cl. ..... 241/264; 241/37; 241/268
(58) Field of Search ..... 241/32, 37, 264, 241/268

(56) References Cited

U.S. PATENT DOCUMENTS

| | | | | | |
|---|---|---|---|---|---|
| 3,918,648 | A | * | 11/1975 | Anthony | 241/268 |
| 3,976,255 | A | | 8/1976 | Edwards | 241/264 |
| 4,165,044 | A | | 8/1979 | Batch | 241/264 |
| 4,398,674 | A | * | 8/1983 | Dremann | 241/264 |
| 4,637,562 | A | | 1/1987 | Hagiwara et al. | 241/259.2 |
| 4,783,013 | A | | 11/1988 | Polzin | 241/219 |
| 4,927,089 | A | | 5/1990 | Altmayer | 241/264 |
| 5,660,337 | A | * | 8/1997 | Falbo et al. | 241/37 |
| 5,725,163 | A | * | 3/1998 | Eloranta et al. | 241/37 |
| 5,765,769 | A | | 6/1998 | Kaya | 241/264 |
| 5,769,334 | A | | 6/1998 | Nakayama et al. | 241/27 |
| 5,799,888 | A | | 9/1998 | Hamaguchi et al. | 241/259 |
| 5,857,630 | A | | 1/1999 | Hamaguchi et al. | 241/259 |
| 6,116,530 | A | * | 9/2000 | Altmayer et al. | 241/264 |

* cited by examiner

*Primary Examiner*—Ed Tolan
(74) *Attorney, Agent, or Firm*—Nilles & Nilles, S.C.

(57) ABSTRACT

A jaw crusher having a stationary jaw and a movable jaw which define a variable crushing gap (or closed side setting), a toggle beam, and a toggle between the toggle beam and the movable jaw, and a toggle seat between the toggle and each of the beam and movable jaw for seating the toggle against the beam and movable jaw. A double-acting hydraulic ram having a connection with the toggle beam for shifting the toggle beam toward and away from the fixed jaw. An abutment is supported by the housing and engageable by the toggle beam for defining an adjustably variable limit of shifting thereof. End caps provide a rigidly guided sliding toggle beam having a plurality of alternatively selectable positions of adjustment. An hydraulic circuit is connected to each end of the relief ram for extending and retracting thereof, a relief valve is provided for the ram for providing a quick discharge path for oil in the rams to vent the latter to substantially lower pressure to thereby provide a rapid overload release of the cylinder when uncrushable material is encountered in the crusher, and a double-acting toggle tension hydraulic ram in the circuit and pivotally connected between the toggle beam and the movable jaw to tension the toggle and its seats together. The jaw crusher and its hydraulic circuit enable the material between the jaws to be cleared when the machine has encountered an unscheduled stop due to, for example, an overload in the system, the failure of the electrical power system, the failure of the belt driving system, or any other unscheduled stops.

23 Claims, 8 Drawing Sheets

JAW CRUSHER TOGGLE BEAM HYDRAULIC RELIEF AND CLEARING

BACKGROUND OF THE INVENTION

1. Field of the Invention

This invention relates generally to jaw crushers wherein a movable jaw that cooperates with a stationary jaw is rockably fulcrumed on a toggle plate which in turn is fulcrumed on a toggle beam that is adjustable in opposite directions toward and from the stationary jaw.

2. Description of the Related Art

A jaw crusher of the general type to which this invention relates is disclosed in U.S. Pat. No. 4,165,044, issued Aug. 21, 1979 to Batch. That patent has been assigned to an assignee common with the present invention and discloses a toggle beam and a transversely shiftable wedge at each end of the beam whereby the toggle beam is wedged downwardly into a position in the way slots of the crusher side walls and locked therein.

Another prior art example of this type of jaw crusher is shown in U.S. Pat. No. 4,783,013, issued Nov. 8, 1988 to Polzin, and which also has been assigned to an assignee common with the present invention. That patent discloses shims behind a toggle beam which define various positions of its fore and aft adjustment along the way slots and in which the ends of the beam are guided.

Another example of the prior art is shown in the U.S. Pat. No. 4,927,089, issued May 22, 1990 to Joseph Altmayer. That patent discloses a pair of hydraulic cylinders or rams for controlling the movement of the movable jaw of a rock crusher between a first set position and a retracted position. That patent has means for simultaneously locking hydraulic fluid in first and second supply conduits to hold an extensible ram in a substantially rigid fixed length condition when in the set position during normal crushing operation. The ram 50 is mounted on one end to a non-adjustable fixed point on the main frame and the other end of the ram connects directly to the movable jaw. The length of the ram extension directly determines the location of the movable jaw.

U.S. Pat. No. 3,976,255, issued Aug. 24, 1976, to Edwards discloses a jaw crusher which utilizes a normal operating position between the jaws. The control system used in that patent is a timed action arrangement which utilizes an air/liquid intensifier for controlling liquid pressure within the cylinder by a supply and exhaust of air to and from the unit.

U.S. Pat. No. 4,637,562, issued Jan. 20, 1987 to Hagiwara et al., discloses hydraulic rams connected to the outlet portion of the breaker plate means and which operate independently of the breaker plate drive means to increase and decrease cyclically and incrementally the spacing between the lower ends of the breaker jaws. Still other examples of the prior art are shown in U.S. Pat. No. 5,799,888, issued Sep. 1, 1988; U.S. Pat. No. 5,765,769, issued Jun. 16, 1998; U.S. Pat. No. 5,769,334, issued Jun. 23, 1998; and U.S. Pat. No. 5,857,630, issued Jan. 12, 1999.

SUMMARY OF THE INVENTION

The present invention provides an eccentric jaw crusher for rock material and the like having a rigidly guided sliding toggle beam and a toggle for being hydraulically urged against the movable jaw to relatively position the movable jaw with respect to a fixed jaw to thereby vary the crusher closed side setting.

More specifically, the present invention provides a parallel hydraulic circuit including one or more double-acting hydraulic rams which provide a reliable overload relief system when tramp iron or other uncrushable material is encountered in the crusher. There is also provided a mechanical fixed stop for the movable jaw to ensure closer control of the closed side setting. With this fixed stop, it is possible to permit the uncrushable object to pass through the crushing chamber, and then the movable jaw is automatically returned to the established closed side setting. The hydraulic circuit provided by the present invention includes direct mounted relief valves, one for each ram, which permit a quick dumping of the oil to vent to a lower pressure area.

The invention thus provides a hydraulically clamping of the toggle beam forward and holding the beam rigid until the clamping force is overcome, for instance, by uncrushable material. A relief force is then transferred from the movable jaw to the toggle and to the toggle beam, to the ram rod and oil in the ram, which will then open the relief valves to dump only enough oil to drop to the preset pressure. A pressure compensated pump supplies makeup oil to restore the ram to its original position.

Another aspect of the invention relates to a crusher of the above type in which the toggle beam can be powered back by hydraulic rams to allow for quick closed side setting changes. The beam can also be powered back to allow for quick crushing chamber clearing of material due to unscheduled stoppage.

The toggle tensioning system provided is accomplished through a hydraulic ram and associated accumulator which is only powered to provide an easily adjustable constant tension force on the toggle and toggle seats. Tension must be maintained to keep the toggle in place between the seats due to the large amount of movement required when the crusher clears an uncrushable object. The movement is greater than a spring will handle effectively.

Another aspect of the invention relates to the adjustable wedges which remove any vertical clearance from the guide slots, and shims are provided to compensate for side-to-side clearance in the frame.

The hydraulic system provided by the present invention removes high shock loads from the frame and reduces many attendant problems.

These and other objects and advantages of the present invention will appear herein as this disclosure progresses.

DESCRIPTION OF THE PREFERRED EMBODIMENT

Figure 1:
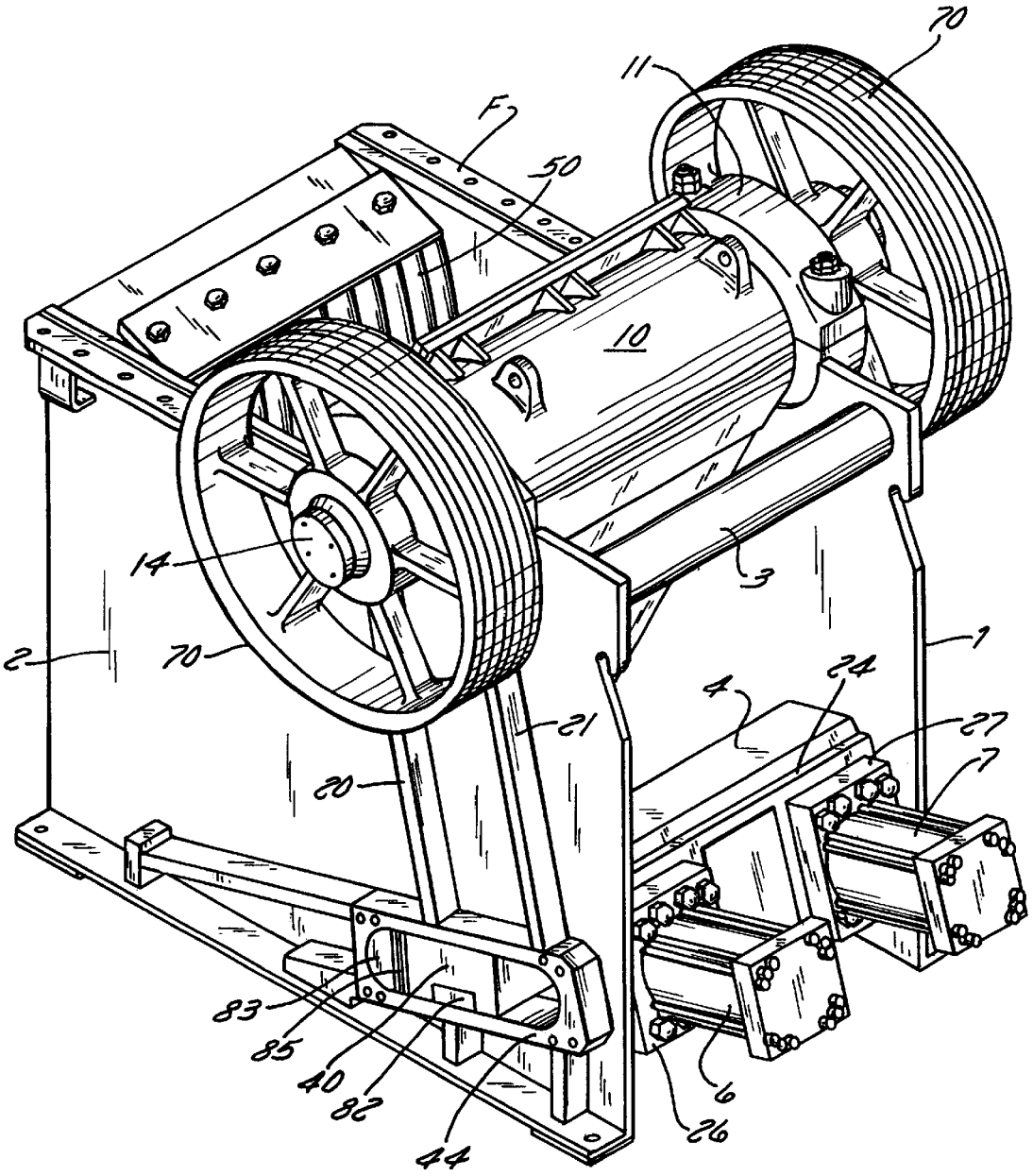
FIG. 1 is a perspective view of the jaw crusher embodying the present invention.

The general organization of the crusher includes a main frame parallel vertical sides 1 and 2 secured rigidly together by the cross brace 3 construction and which is welded to the side frames, and the members 4, 5, and 24 which are welded between the side walls and which form a frame for mounting two hydraulic rams 6 and 7. Positioned across the rear edges of frame members 4 and 5 is a mounting plate 24 which is welded to the side walls and members 4 and 5 to form a rigid unitary structure in which is mounted the large double-acting hydraulic rams 6 and 7, now to be described. A large cast steel housing 10 which is rigidly mounted in the saddles 11 and 12 which in turn are welded to the side walls 1 and 2, respectively. This housing 10 encloses the jaw crusher overhead eccentric shaft 14 in anti-friction bearings in the well known and conventional manner.

Figure 4:
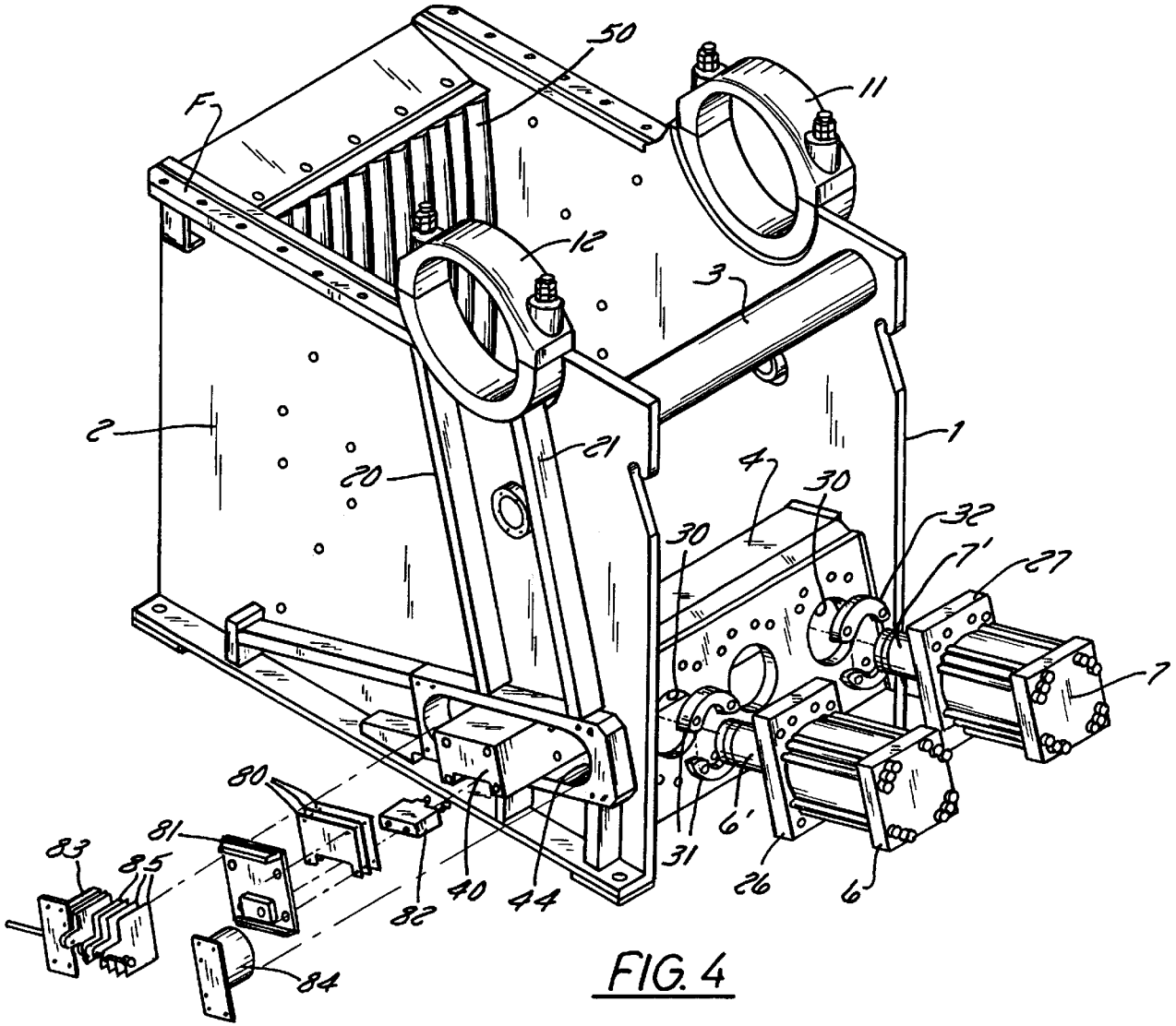
FIG. 4 is a perspective view of the crusher, with parts broken away or removed or shown in an exploded fashion for clarity in the drawings.

The main frame also includes suitable reinforcing steel members 20, 21 which are welded to the side walls (FIGS. 1 and 4).

The hydraulic relief rams 6 and 7 are themselves conventional in nature and have cylinder rods 6' and 7', respectively, extending therefrom. The rod end of the rams have the conventional heads 26 and 27 by means of which they are bolted to the mounting plate 24. The mounting plate 24 has suitable apertures 30 through which the piston rods extend.

As shown in FIG. 4, cylinder rod retaining clamps 31 and 32 mount to the toggle beam 40 as being bolted thereto in conventional manner by means of bolts.

Figure 2:
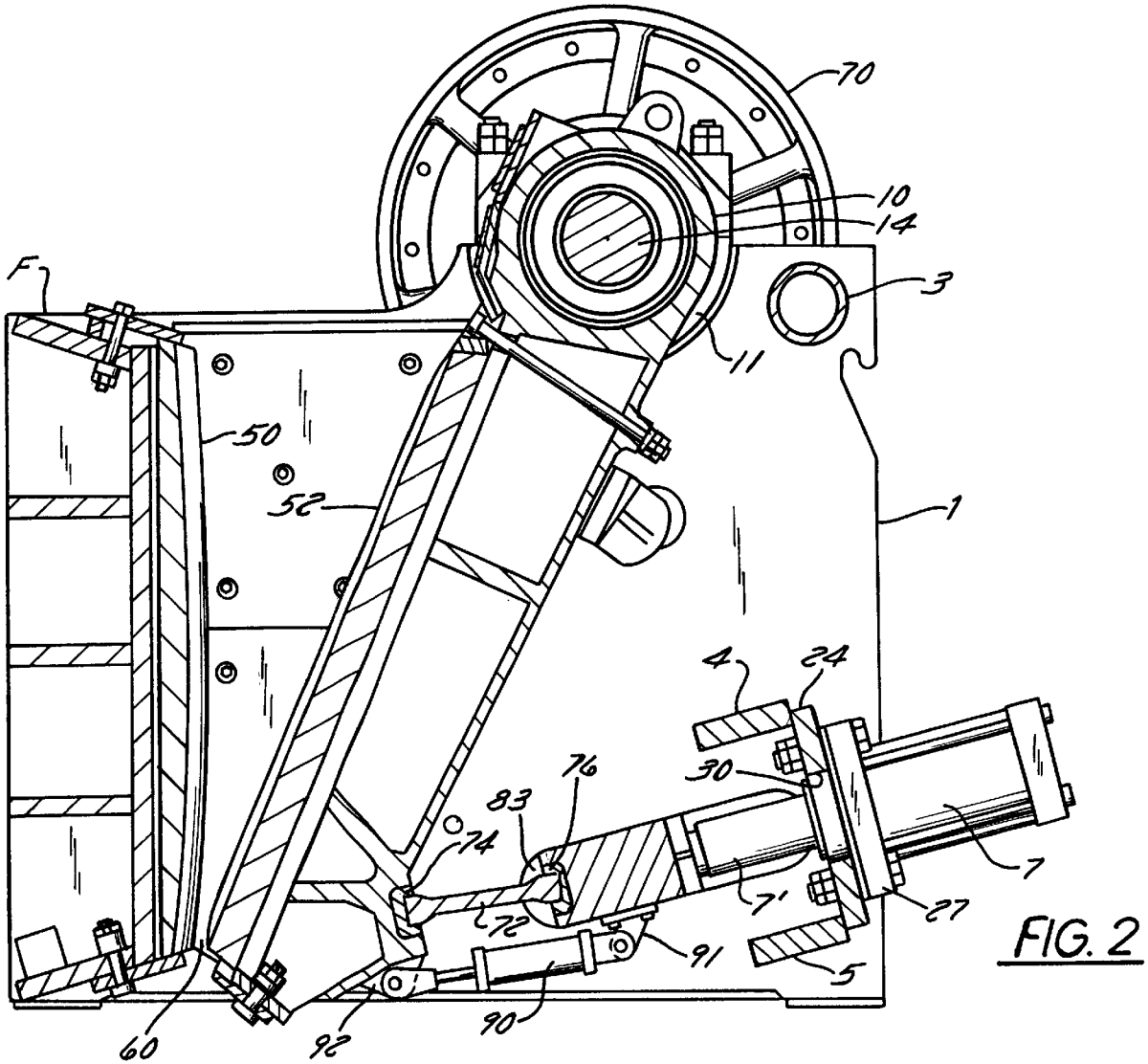
FIG. 2 is a vertical, longitudinal cross-sectional view through the jaw crusher, more or less schematic in character.

The toggle beam 40 is generally elongated and extends between the side walls 1 and 2 and is furthermore generally rectangular in cross section and slides in the guides 44. The guides 44 have elongated openings and are welded to the side walls. The toggle beam is rigidly guided and slides in the guide 44 by the hydraulic relief rams 6 and 7, to thereby allow placing of shims 85 to adjust the closed side setting 60 between the fixed jaw 50 and the movable jaw 52 at the lower edges thereof (FIG. 2). The rams are used to move the toggle beam when setting closed side setting with shims 85. The upper end of the movable jaw 52 is mounted by its eccentric shaft 14 to cause the movable jaw to oscillate back and forth to effect the crushing action of the material between the jaws in the known manner.

A large V-belt pulley 70 is provided at one end of the shaft 14 and through which power is furnished (from a source not shown) to cause the movable jaw 52 to be moved, as indicated.

The connection between the toggle beam 40 and the lower end of the swing jaws is provided by an elongated toggle 72 (FIGS. 2, 3, 5 and 6).

Figure 3:
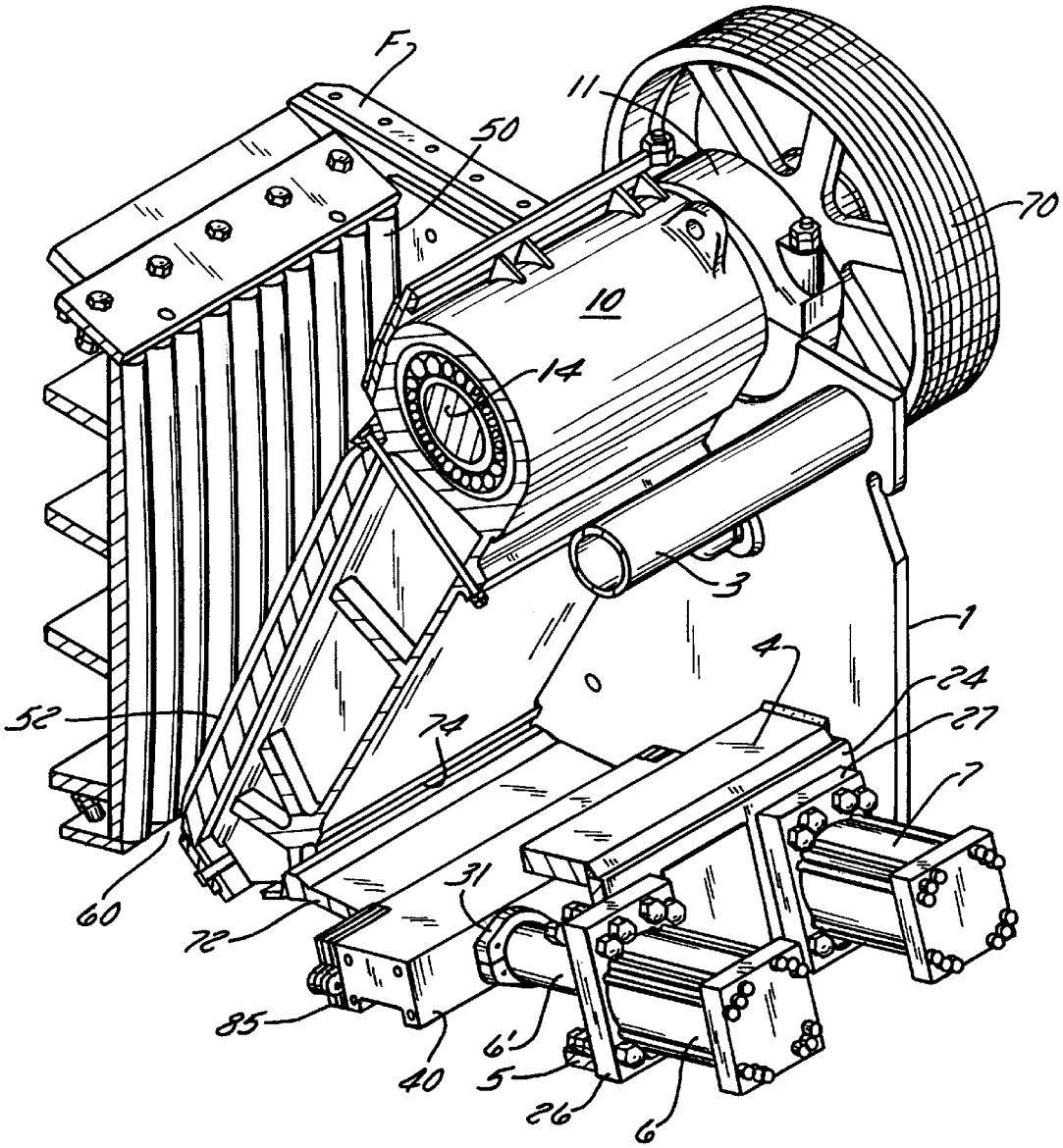
FIG. 3 is a perspective view of the crusher shown in FIG. 1 but with parts broken away or remove or the sake of clarity.
Figure 5:
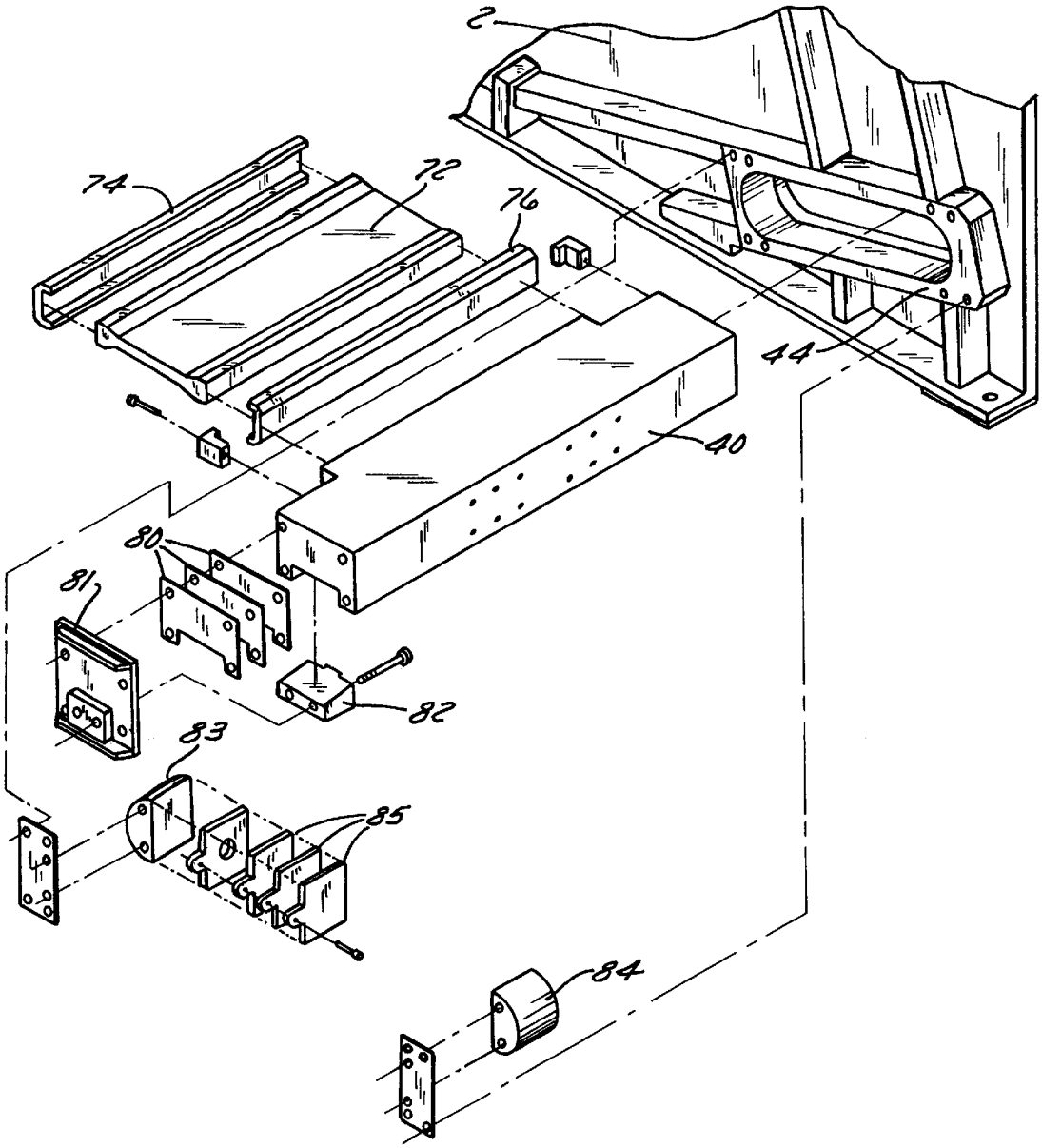
FIG. 5 is a perspective, exploded view of portions of the parts shown in FIG. 4 but on an enlarge scale.

As shown in FIGS. 2, 3 and 5, one end of the toggle 72 is seated in a correspondingly shaped channel member or seat 76 located in the front face of the toggle beam 40. The other end of the toggle is firmly seated in channel member or seat 74 located on the lower end of the movable jaw.

The two large double-acting hydraulic rams 6 and 7 act to move the toggle beam 40 in the side frames in any adjusted position as determined by the crusher closed side setting 60 desired between the lower end of the jaws. In this manner, the sliding toggle beam is rigidly guided to allow a parallel hydraulic circuit to function and provide a more reliable overload relief system, as will appear.

As shown in FIGS. 4 and 5, beam shims 80 and beam retainer 81 are secured to the ends of the beam 40. By use of these beam retainers, the beam position cannot become skewed with the main frame and instead with the beam retainers located on the ends of the toggle beam, the beam can only slide to and from the stationary jaw in a parallel motion. The retainers bear against the outside of the main frame to ensure the beam will stay square with the frame. Wedges are used which allow for the height adjustment of the toggle beam to ensure a better sliding fit between the beam and the slots in the main frame, for example. A toggle beam wedge 82 is secured in the lower side ends of the beam 40 to provide a height adjustment for the beam. FIG. 4 also shows shims 85 (which are insertable in guides 44) for setting the crusher closed side setting, as shown in FIG. 5, curved end plate 83 is provided for securing the shims 85 in position in the crusher to form a fixed top. The curved end plate 84 acts as a return stop for the beam when it is retracted, as will appear.

Thus, the toggle beam 40 is rigidly and accurately secured in the elongated slot 44 in each of the side walls of the crusher. In the above manner, the toggle and toggle beam are held in any desired position by the hydraulic relief rams, rather than being mechanically locked to the side frame.

More hydraulic relief rams may be provided for additional holding power. In the event a smaller crusher is used, a single relief ram may be sufficient.

With the above described structure it is possible to maintain a mechanical fixed stop to ensure more control of the closed side setting as determined by shims 85. With the above described structure, the toggle beam 40 is allowed to slide away from the fixed stop, permitting uncrushable objects to pass through the crushing chamber. The toggle beam 40 will then return to the established closed side setting against the fixed stop.

Figure 6:
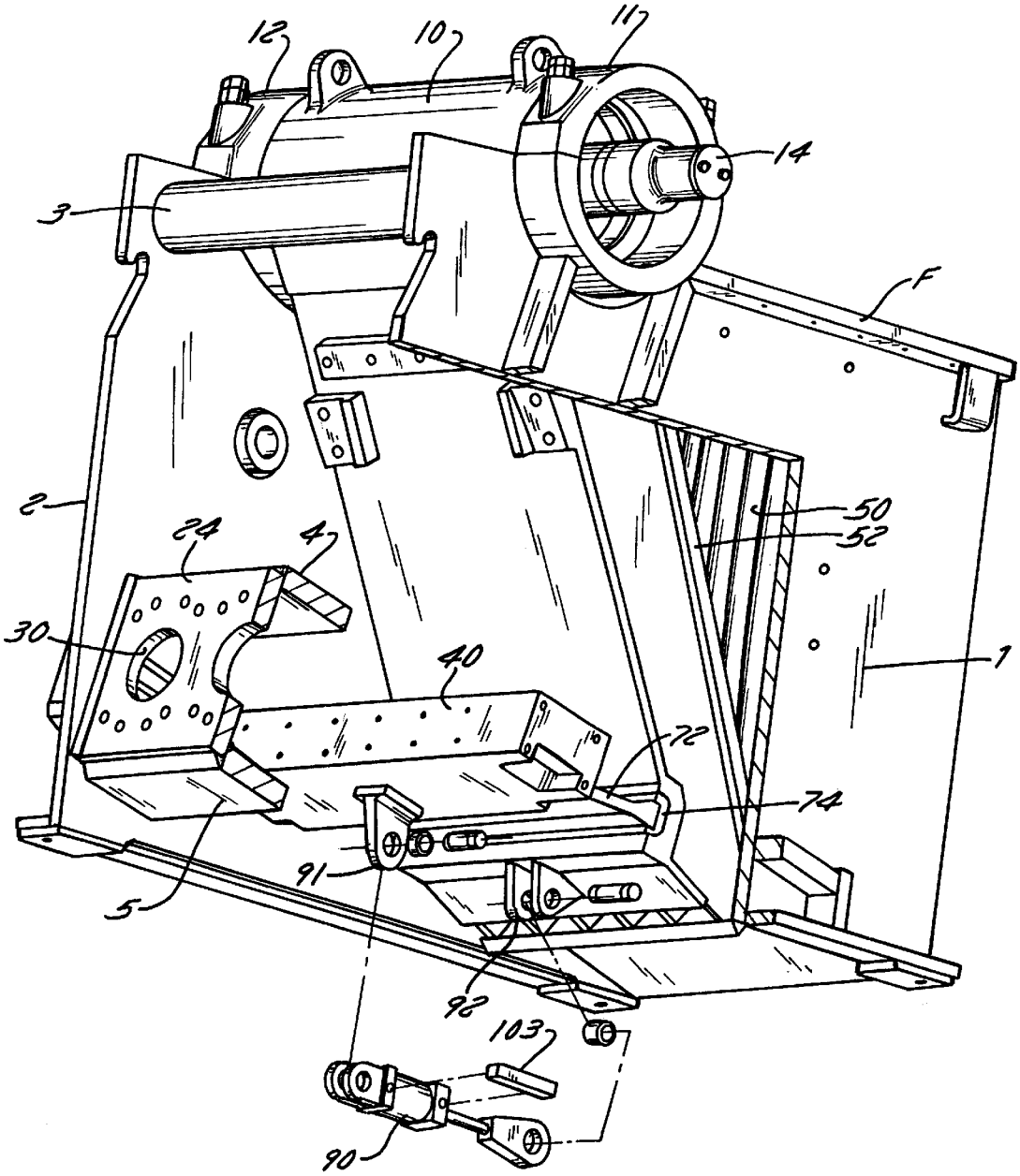
FIG. 6 is a perspective, fragmentary view of the crusher shown in the other views but taken generally from the opposite side thereof and showing certain parts as being broken away or removed for the sake of clarity.
Figure 7:
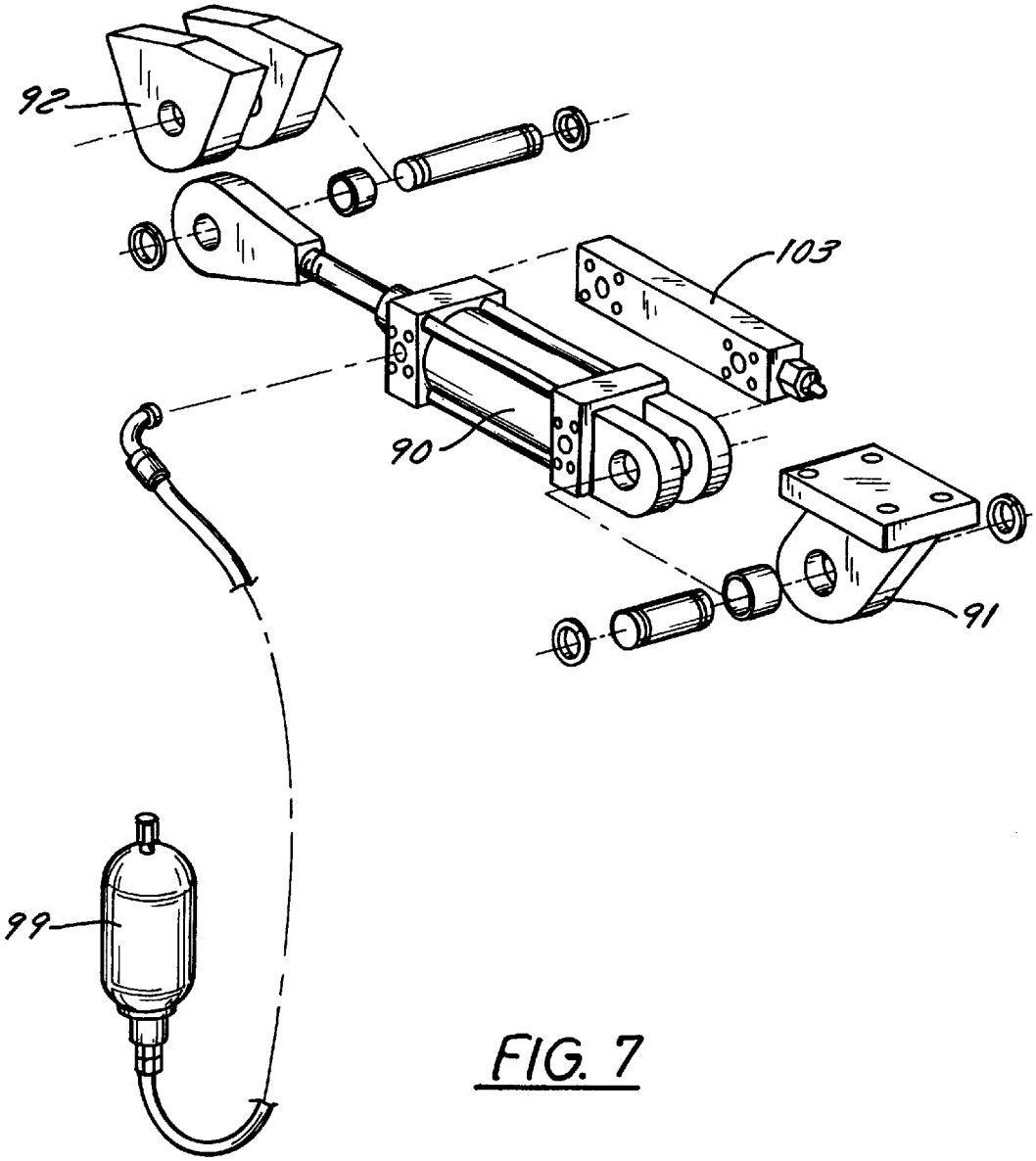
FIG. 7 is an exploded perspective view of a toggle tension ram and its mounting brackets, shown in FIG. 6, but on an enlarged scale.

As shown in FIGS. 6 and 7, a double-acting toggle tension hydraulic ram 90 is provided between the toggle beam 40 and the lower end of the swing jaw. The toggle tension ram 90 is pivotally connected to a mounting bracket 91 (FIGS. 6 and 7) on the lower side of the toggle beam and to the mounting bracket 92 which is welded to the lower end of the movable jaw. The toggle tensioning ram 90 eliminates the need for springs to tension the toggle and its seats 74, 76. This tension is now provided with the hydraulic ram 90 and its accumulator 99 (FIG. 7) which is powered to provide an easily adjustable tension force.

Figure 8:
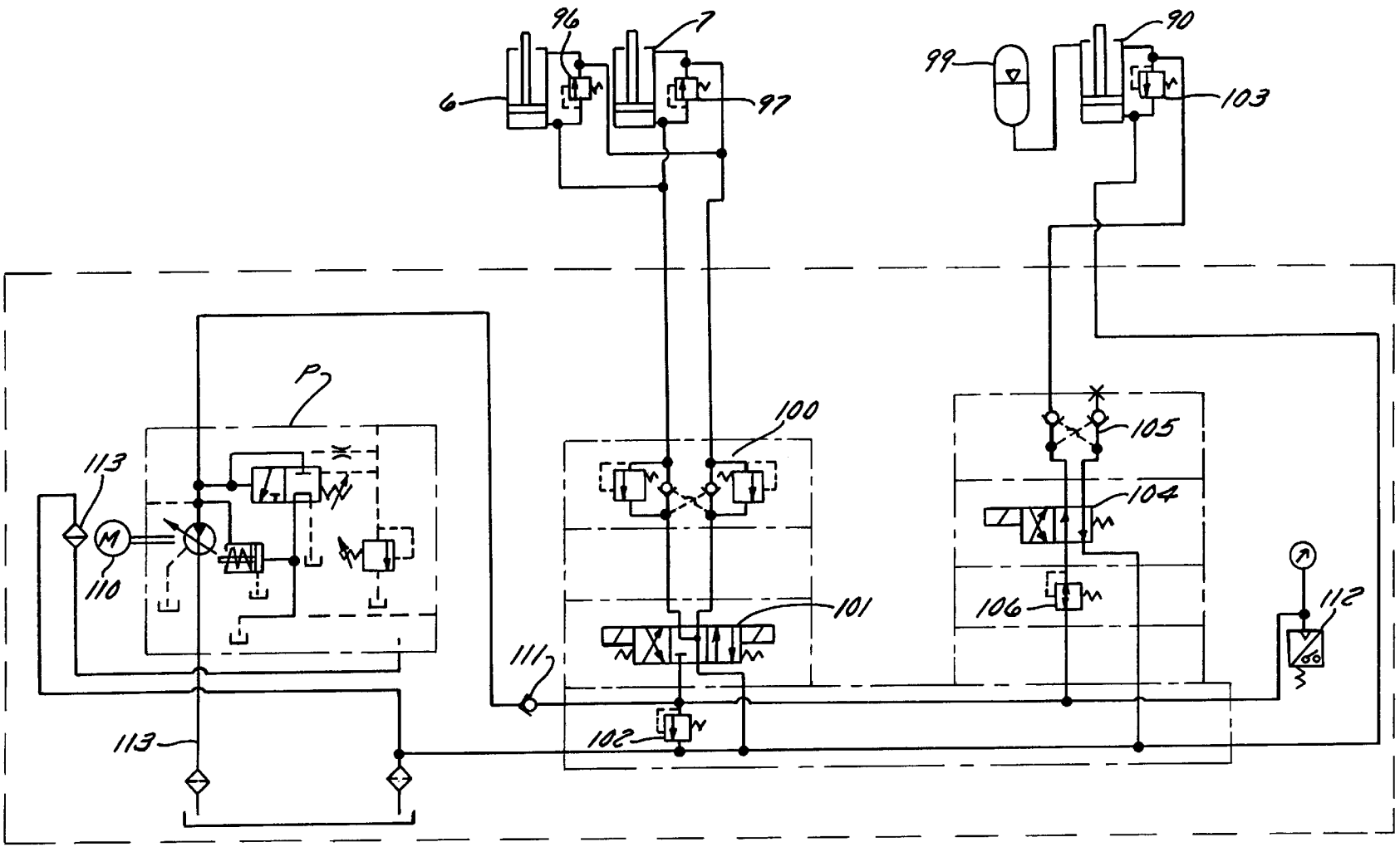
FIG. 8 is a hydraulic, schematic drawing of the crusher iron relief rams which are shown in FIGS. 1, 2, 3 and 4, and also showing the counterbalanced valve, the directional control valve, and the toggle tension valve.

With the hydraulic circuit is shown in FIG. 8, the invention provides for hydraulically clamping the beam 40 forward and holding the beam rigid against the shims 85 until the clamping force of the rams is overcome (by uncrushable material) which will then open the relief valves 96, 97 to dump only enough oil to drop to the preset pressure. The present hydraulic circuit provides a relief and automatically returns the jaw to the original adjustable fixed stop. In other words, the hydraulic circuit allows oil from the cylinder to vent to a lower pressure by means of a relief valve and, by connection, move the movable jaw away from the stationary jaw until the uncrushable material passes between the jaws. Once the uncrushable material passes, the pressure in the cylinder will drop below the preset relief pressure, the pump will replace the oil vented, and the beam will return to its adjustable fixed stop. The opening between the jaws can be easily adjusted by shifting the directional control valve to retract the beam to allow for insertion of shims to vary the fixed stop for the beam. The pressure compensated pump P will supply the makeup oil to restore the rams to their original set positions. The direct mounted relief valves allow for a quick path for the oil to vent to a lower psi area.

The adjustable wedges 82 remove any vertical clearance from the guide slots on the sides of the crusher. Furthermore, shims 80 are provided to compensate for side-to-side clearance in the frame. All the sliding surfaces have replaceable linear bearing material on them.

This hydraulic system will prevent high shock loads from being transferred to the frame and replaces the need of a mechanical fuse as when the toggle is used as a conventional machine.

FIG. 8 shows the hydraulic circuitry for the two relief/one tension ram configuration and includes the crusher tramp iron relief rams 6 and 7, the dual counterbalance valve 100 which is a combination of a two valves and two pilot operated check valves. The directional control valve 101 provides for retraction or extension of the relief rams 6, 7 in the known manner. A system relief valve 102 is also provided in the circuit. In regard to the double-acting toggle tension ram 90, a toggle tension relief valve 103, a directional control valve 104, and a pilot operated check valve 105 are provided. A pressure reducing valve 106 is provided and may provide a lower pressure than system pressure. In regard to powering the hydraulic circuit, an electric motor 110 drives the pump P which provides the necessary oil flow and pressure for the circuit. Suitable check valves 111, low pressure switch 112, and oil cooler 113 are provided as conventional.

The present invention which can retain the toggle beam eliminates the potential or the beam's position to become skewed with the main frame. With the beam retainers located on the ends of the toggle beam, the beam can only slide to and from the stationary jaw in a parallel motion. The retainers bear against the outside of the main frame to ensure the beam will stay square with the frame. The present invention also utilizes wedges that allow for height adjustment of the toggle beam to ensure a better sliding fit between the beam and slots or ways of the main frame.

The hydraulic tension ram 90 that connects on one end to the movable jaw and on the other end to the bottom of the toggle beam acts as a clamp-like retention device for the toggle. Due to the range of motion that the present design must cover, prior art devices for maintaining clamping pressure throughout the bearing length, such as springs, were unsatisfactory. The present invention utilizes a hydraulic ram to give an adjustably constant clamp pressure. The ram applies the predetermined set pressure to clamp the toggle between its seats. Thus, the pressure applied by the ram will be constant. Furthermore, the hydraulic ram tension can be varied by adjusting the pressure reducing valve.

The present invention allows the operator to clear the machine of excess material when the machine has stopped due to an overload of material in the machine, the electricity powering the machine goes out for some reason or another, the belt mechanism may break or other unscheduled stops occur. In these cases, the jaws can be powered open to clear the machine from material that has accumulated in the crushing chamber. In other words, the chamber is opened to permit the accumulated material to fall out from between the jaws.

Recapitulation

With this arrangement, a rigidly guided sliding toggle beam allows a parallel hydraulic circuit to function and provide for a reliable overload relief system. The relief valves 96 and 97 in the relief rams 6 and 7 allow for a quick path for oil to vent to a lower psi area, as mentioned. The present arrangement provides for hydraulically clamping the beam in the forward (crushing) position, holding the beam rigid until the clamping force is overcome (by uncrushable material) which will open the relief valves (96, 97) and then release only enough oil to drop the preset pressure. When the uncrushable material passes, the pressure in the ram will drop below the preset relief pressure, and the compensated pump P will supply the makeup oil to restore the rams to their original fixed stop position.

The present hydraulic system prevents high shock loads on the crusher frame and replaces the need for a mechanical fuse link when the toggle is used in a conventional manner. The present arrangement maintains a mechanical fixed stop for the toggle beam to ensure more control of the closed side setting as determined by the shims 85, as mentioned This allows for an uncrushable object in the jaws to pass between the jaws and the jaw 52 is automatically returned to the established closed setting. A toggle tensioning system is provided by an hydraulic ram and an accumulator which provides an easily adjustable tension force.

What is claimed is:

1. A jaw crusher comprising a housing that supports a stationary jaw and has a pair of opposed upright walls between which a movable jaw is suspended, each of said walls defines a way slot that is elongated in directions toward and from the stationary jaw, a toggle beam extending across the housing and having opposite end portions received in said way slots and substantially confined by them for slidable shifting in said directions, a toggle between said toggle beam and the movable jaw for supporting the latter, a toggle seat between said toggle and each of said beam and movable jaw for seating said toggle against said beam and movable jaw;

double-acting hydraulic ram means having a cylinder and a double-acting piston extendable from one end of said cylinder, said piston having a connection with said toggle for shifting said toggle in said directions, said cylinder having a rigid connection with said housing and extending between said side walls;

abutment means supported by the housing and engageable by the toggle beam for defining an adjustably variable limit of shifting thereof in one of said directions and thus providing a rigidly guided sliding toggle beam having a plurality of alternatively selectable positions of adjustment of the toggle beam;

an hydraulic circuit connected to said cylinder for extending and retracting said piston;

a tramp iron relief valve between opposite ends of said cylinder for providing a quick discharge path for oil in said cylinder to vent the latter to substantially lower pressure to thereby provide a rapid overload relief of said cylinder when tramp material is encountered in said crusher;

a directional control valve in said circuit and connected with said ram means for retracting or extending said pistons; and said hydraulic circuit providing for power opening of said movable jaw to permit clearing of said crushing chamber when an unscheduled stop occurs due to failure of the electrical system, the drive means or excessive material in said crushing chamber.

2. The crusher set forth in claim 1 including an adjustable fixed stop in said abutment means for defining said limit of shifting said beam.

3. The crusher described in claim 1 including adjustable shims for adjusting said fixed stop.

4. The crusher as set forth in claim 1 including beam retainers secured to the end of said beam and bearing against said housing to ensure said beam can slide to and from the stationary jaw in a parallel motion and remain square with the housing.

5. The crusher described in claim 1 including adjustable wedges secured to said beam to provide a height adjustment of said beam to ensure a good sliding fit between said beam and said abutment means.

6. The crusher set forth in claim 1 including a double-acting toggle tension hydraulic ram in said circuit and pivotally connected between the toggle beam and said movable jaw to tension the toggle and its seats together.

7. A jaw crusher comprising a housing and having a pair of opposed upright side walls, a stationary jaw fixed between said side walls, a movable jaw suspended between said side walls, for swingable relationship with said movable jaw, each of said side walls having a way slot that is elongated in directions toward and from the stationary jaw, a toggle beam extending across the housing and having opposite end portions received in said way slots and substantially confined and rigidly guided by said slots for slidable shifting in said directions, a toggle between said toggle beam and the movable jaw for engaging and supporting the latter, a generally channel-shaped toggle seat between said toggle and each of said beam and movable jaw for seating said toggle firmly against said beam and movable jaw;

double-acting hydraulic ram means having a cylinder and a double-acting piston rod extendable from one end of said cylinder, said piston rod having a connection with said toggle for shifting said toggle in said directions, said cylinder having a rigid connection with said housing and extending between said side walls;

adjustable abutment means in said way slots and engageable by the toggle beam for defining an adjustably variable limit stop of shifting thereof in one of said directions and thus providing a rigidly guided sliding toggle beam having a plurality of alternatively selectable positions of adjustment of the toggle beam;

an hydraulic circuit connected to said cylinder for extending and retracting said piston rod;

a tramp iron relief valve in said circuit and between opposite ends of said cylinder for providing a quick discharge path for oil in said cylinder to vent the latter to substantially lower pressure to thereby provide a rapid overload relief of said cylinder when tramp material is encountered in said crusher; and a directional control valve in said circuit and connected with said ram means for retracting or extending said piston rod.

8. The crusher set forth in claim 7 including an adjustable and fixed stop in said way slot for defining said limit of shifting said beam.

9. The crusher described in claim 7 including adjustable shims for adjusting said limit stop.

10. The crusher as set forth in claim 7 including beam retainers secured to the end of said beam and bearing against said housing side wall to said beam can slide to and from the stationary jaw in a parallel motion and remain square with the side walls.

11. The crusher described in claim 7 including adjustable wedges secured to said beam to provide a height adjustment of said beam to ensure a good sliding fit between said beam and said way slots.

12. The crusher set forth in claim 7 including a double-acting toggle tension hydraulic ram in said circuit and pivotally connected between the toggle beam and said movable jaw to tension the toggle and its seats together, and an hydraulic accumulator connected with said ram which provides an easily adjustable tension force.

13. A jaw crusher comprising a housing that has a pair of upright walls between which a movable jaw is movable relative to a fixed jaw, each of said walls defines a way slot that is elongated in directions toward and from the stationary jaw, a toggle beam extending across the housing and having opposite end portions received in said way slots and substantially confined by them for slidable shifting in said directions, a toggle between said toggle beam and the movable jaw for supporting the latter, a toggle seat which is generally C-shaped in cross section and is located between said toggle and each of said beam and movable jaw for seating said toggle against said beam and movable jaw;

double-acting hydraulic ram means having a connection with said toggle for shifting said toggle in said directions, an hydraulic circuit connected to each of said rams for extending and retracting said rams and consequently shifting said toggle beam, and a double-acting toggle tension hydraulic ram in said circuit and pivotally connected between the toggle beam and said movable jaw to tension the toggle and its seats together.

14. The crusher set forth in claim 13 including an adjustable and fixed stop in said way slot for defining said limit of shifting said beam.

15. The crusher described in claim 14 including adjustable shims for adjusting said limit stop.

16. The crusher as set forth in claim 13 including beam retainers secured to the end of said beam and bearing against said housing side wall to said beam can slide to and from the stationary jaw in a parallel motion and remain square with the side walls.

17. The crusher described in claim 13 including adjustable wedges secured to said beam to provide a height adjustment of said beam to ensure a good sliding fit between said beam and said way slots.

18. A jaw crusher comprising a housing that supports a stationary jaw and has a pair of opposed upright walls between which a movable jaw is suspended, each of said walls defines a way slot that is elongated in directions toward and from the stationary jaw, a toggle beam extending across the housing and having opposite end portions received in said way slots and substantially confined by them for slidable shifting in said directions, a toggle between said toggle beam and the movable jaw for supporting the latter;

double-acting hydraulic ram having a cylinder and a double-acting piston extendable from one end of said cylinder, said piston having a connection with said toggle for shifting said toggle in said directions, said cylinder having a rigid connection with said housing and extending between said side walls;

abutment means in said way slot engageable by the toggle beam for defining an adjustably variable limit of shifting thereof in one of said directions;

an hydraulic circuit connected to said cylinder for extending and retracting said piston;

a tramp iron relief valve between opposite ends of said cylinder for providing a quick discharge path for oil in said cylinder to vent the latter to substantially lower pressure to thereby provide a rapid overload relief of said cylinder when tramp material is encountered in said crusher; and a directional control valve in said circuit and connected with said ram means for retracting or extending said pistons.

19. The crusher described in claim 18 including adjustable shims for adjusting said limit.

20. The crusher as set forth in claim 18 including beam retainers secured to the end of said beam and bearing against said housing to ensure said beam can slide to and from the stationary jaw in a parallel motion and remain square with the housing.

21. The crusher described in claim 18 including adjustable wedges secured to said beam to provide a height adjustment of said beam to ensure a good sliding fit between said beam and said abutment means.

22. The crusher set forth in claim 18 including a double-acting toggle tension hydraulic ram in said circuit and pivotally connected between the toggle beam and said movable jaw.

23. The crusher and hydraulic circuit of claim 18 wherein said rams can be operated to power open said jaws in the event of an unscheduled stoppage of said crusher to thereby clear said material in said crusher.

* * * * *